US005127971A

United States Patent [19]

Komatsubara et al.

[11] Patent Number: 5,127,971

[45] Date of Patent: Jul. 7, 1992

[54] METHOD OF PRODUCING GRAIN ORIENTED SILICON STEEL SHEETS HAVING IMPROVED MAGNETIC PROPERTIES AND BENDING PROPERTIES BY ELECTROLYTIC DEGREASING

[75] Inventors: Michiro Komatsubara; Yasuyuki Hayakawa; Mitsumasa Kurosawa; Takahiro Kan; Toshio Sandayori, all of Chiba, Japan

[73] Assignee: Kawasaki Steel Corporation, Japan

[21] Appl. No.: 656,787

[22] Filed: Feb. 15, 1991

[30] Foreign Application Priority Data

Feb. 20, 1990 [JP] Japan ..... 2-37155

[51] Int. Cl.[5] ..... H01F 1/04

[52] U.S. Cl. ..... 148/111; 148/112; 148/113; 204/129.43

[58] Field of Search ..... 148/111, 112, 113, 308, 148/27, 28; 204/129.43

[56] References Cited

U.S. PATENT DOCUMENTS 4,178,194 12/1979 Atterri et al. ..... 148/111
4,642,141 2/1987 Iida et al. ..... 148/113
4,975,127 12/1990 Kurosawa et al. ..... 148/111

FOREIGN PATENT DOCUMENTS 0190020 8/1986 Japan .

*Primary Examiner*—Richard O. Dean
*Assistant Examiner*—Sikyin Ip
*Attorney, Agent, or Firm*—Austin R. Miller

[57] ABSTRACT

The production of grain oriented silicon steel sheets comprises a combination of hot rolling step, cold rolling step, decarburization and primary recrystallization annealing step, annealing separator applying step and secondary recrystallization annealing and purification annealing step. In this case, the cold rolled sheet is subjected to an electrolytic degreasing in a silicate bath containing an iron concentration of 50–5000 mg/l, and Cu is adhered to the surface(s) of the sheet after the decarburization and primary recrystallization annealing in an amount of 400–2000 mg/m$^2$ per one-side surface.

4 Claims, 3 Drawing Sheets

METHOD OF PRODUCING GRAIN ORIENTED SILICON STEEL SHEETS HAVING IMPROVED MAGNETIC PROPERTIES AND BENDING PROPERTIES BY ELECTROLYTIC DEGREASING

BACKGROUND OF THE INVENTION

1. Field of the Invention

This invention relates to a method of producing grain oriented silicon steel sheets having improved bending properties and magnetic properties in the rolling direction of the sheet.

2. Related Art Statement

The grain oriented silicon steel sheets are mainly used as a iron core for transformers and other electrical machinery and apparatus, so that it is required to have excellent magnetic properties, particularly low iron loss (represented by $W_{17/50}$).

For this end, in the grain oriented silicon steel sheet, it is required to highly align <001> orientation of secondary recrystallized grains in the steel sheet toward the rolling direction and also to reduce impurities and precipitates existent in steel of the final product as far as possible. In the grain oriented silicon steel sheets produced by considering these requirements, the iron loss value has been improved from year to year by many efforts up to the present. Recently, there are obtained low iron loss products having a thickness of 0.23 mm and indicating a $W_{17/50}$ value of about 0.90 W/kg.

However, it strongly tends to proVide electrical machinery and apparatus having less power loss with last energy crisis, and consequently it is demanded to develop grain oriented silicon steel sheets having a lower iron loss value as a material for the iron core.

As a method of reducing the iron loss of the grain oriented silicon steel sheet, there are generally known metallurgical methods, i.e. a method of increasing Si amount, a method of thinning the product thickness, a method of fining secondary recrystallized grains, a method of reducing the amount of impurities, a method of highly aligning secondary recrystallized grains into (110)[001] orientation, and so on.

In order to highly align the secondary recrystallized grains into (110)[001] orientation, it is necessary to rapidly conduct secondary recrystallization while sufficiently controlling the growth of normal grains, so that the reinforcement of control force is required.

As a means for reinforcing the control force, the addition of Cu to steel has been known from the old time. For example, Japanese Patent Application Publication No. 48-17688 discloses that the control force is reinforced by adding 0.10–0.30% of Cu to migrate MnTe into grain boundary. Further, Japanese Patent laid open No. 50-15726 proposes a technique that the restriction of hot rolling conditions due to the precipitation of inhibitor is mitigate by adding 0.1–0.5% of Cu and using manganese copper sulfide as an inhibitor to lower the dissolving temperature of the inhibitor during the heating of slab. And also, Japanese Patent Application Publication No. 54-32412 discloses a technique that the magnetic flux density is increased by adding 0.2–1.0% of Cu or Ni and making proper the draft and the final finish annealing. Moreover, Japanese Patent laid open No. 61-12822 discloses a technique that the control force is reinforced to improve the magnetic properties by adding 0.02–0.20% of Cu to finely precipitate $(Cu, Mn)_{1.8}S$ as an inhibitor.

According to the inventors' studies, however, it has been found that the addition of Cu to steel is not essential to the reinforcing effect of the control force but is effective to the degradation of the control force at the surface layer portion of the steel sheet. In this connection, the inventors have found that since the control force at the surface layer portion of the steel sheet in the secondary recrystallization is degraded at the annealing step in the factory production, in order to avoid such a degradation phenomenon and maintain the sufficient control force at the surface layer portion, it is effective to uniformly adhere a metal having an electrode potential higher than that of Fe to the steel sheet surface before or after decarburization and primary recrystallization annealing, and disclosed this technique in Japanese Patent laid open No. 61-190020.

Incidentally, according to the inventors' studies, it has been confirmed that when Cu is added to steel, the size and distribution of the inhibitor precipitated at the hot rolling step are certainly fine and the precipitating frequency is high, but the inhibitor is apt to cause Ostwald growth by a heat treatment at high temperature in the post steps (for example, annealing of the hot rolled sheet, intermediate annealing, final finish annealing) and consequently the control force is frequently lowered to bring about the degradation of the magnetic properties. Furthermore, in the steel sheets containing Cu, the surface cracking is apt to be caused in the hot rolling, whereby the surface properties of the final product are degraded, and also the side end face of the coil after the final finish annealing is wavily bent or undesirably folded.

That is, the aforementioned problems have been solved by the above technique described in Japanese Patent laid open No. 61-190020 in order to improve the magnetic properties. However, it has been confirmed from later studies that the following problems are still existent in this technique.

Even in the adoption of the above technique, the stability of the magnetic properties is poor and also the breakage is undesirably caused when the final roduct is subjected to a bending work (which is generally called as bending properties). If the transformer is manufactured by using the product having such poor bending properties, the cracking is caused, for example, in the steel sheet to considerably degrade the performances of the transformer, and in the worst case, the insulating property between the laminated steel sheets is obstructed to cause a serious trouble such as baking of the transformer or the like.

In order to avoid these problems, it is effective to select Cu as a metal element to be adhered to the steel sheet surface and increase the amount of Cu adhered as disclosed in the above Japanese Patent laid open No. 61-190020. However, when the amount of Cu adhered is increased, the magnetic properties are largely degraded.

SUMMARY OF THE INVENTION

It is, therefore, an object of the invention to advantageously solve the above problems and to provide a method of advantageously producing grain oriented silicon steel sheets having excellent magnetic properties as well as bending properties.

The inventors have found that when electrolytic degreasing is adopted as a treatment after final cold rolling and amount of iron in the electrolytic degreasing bath is relatively large, the adhering effect of Cu to a post step may be effectively utilized, and as a result the invention has been accomplished.

According to the invention, there is provided of a method of producing grain oriented silicon steel sheets having improved magnetic properties and bending properties by a series of steps of hot rolling a slab of silicon steel containing at least one of S, Se and Al as an inhibitor, subjecting the resulting hot rolled sheet to a heavy cold rolling or two cold rolling steps through intermediate annealing to make a cold rolled sheet having a final thickness, subjecting the resulting cold rolled sheet to decarburization and primary recrystallization annealing, applying a slurry of an annealing separator consisting mainly of MgO to the surface of the steel sheet and then subjecting the sheet to secondary recrystallization annealing and purification annealing, characterized in that the steel sheet after final cold rolling is subjected to electrolytic degreasing in an electrolytic degreasing bath of a silicate solution containing 50–5000 mg/l of iron therein, and that one or both surfaces of the steel sheet after the decarburization and primary recrystallization annealing is uniformly coated with Cu in an amount of 400–2000 mg/m$^2$ per one-side surface.

BRIEF DESCRIPTION OF THE DRAWINGS

The invention will be described with reference to the accompanying drawings, wherein.

DESCRIPTION OF THE PREFERRED EMBODIMENTS

Figure 1C:
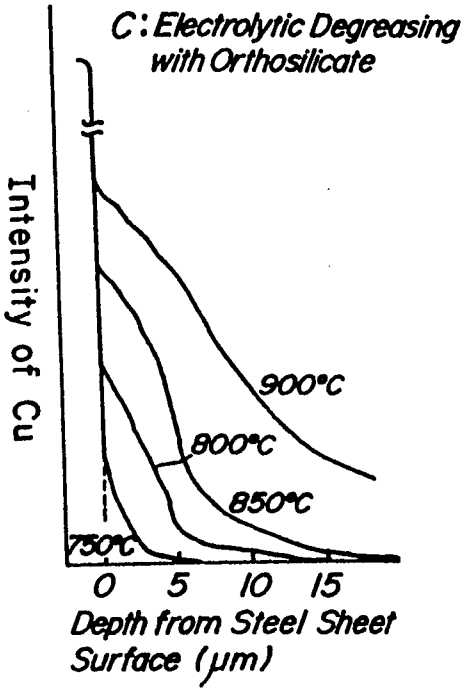
FIGS. 1*a* to 1*c* are graphs showing a relation between holding temperature and penetration depth of Cu from the steel sheet surface when the degreasing treatment is carried out by various methods and Cu is uniformly applied and then held at various temperatures, respectively.

In the production steps for grain oriented silicon steel sheets, the cold rolled steel sheet having a final thickness is usually subjected to a decarburization annealing for removing harmful carbon. By such an annealing, the steel sheet is rendered into a primary recrystallization texture containing a second phase of finely dispersed inhibitor therein, and at the same time the surface layer of the steel sheet has a subscale structure that fine $SiO_2$ grains are dispersed into base metal. After the slurry of the annealing separator consisting mainly of MgO is applied to the steel sheet surface, this sheet is subjected to secondary recrystallization annealing and subsequently to purification annealing at a high temperature of about 1200° C. In this case, the crystal grains of the steel sheet form coarse grains of (110)[001] orientation by the secondary recrsytallization annealing, while a greater part of S, Se, Al, N and the like as an inhibitor existent in the steel sheet are removed out from the base metal of the steel sheet by the high-temperature purification annealing.

Furthermore, $SiO_2$ contained in the subscale of the surface layer reacts with MgO in the annealing separator applied to the surface of the steel sheet according to the following equation in the purification annealing to form a polycrystalline coating called as forsterite ($Mg_2SiO_4$):

$$2MgO + SiO_2 \rightarrow Mg_2SiO_4$$

In this case, an extra amount of MgO serves an an unreacted substance to prevent fusing between the steel sheets. After the unreacted annealing separator is removed out from the steel sheet subjected to the high-temperature purification annealing, the sheet is subjected to an insulative topcoating treatment and a heat treatment for removing coil set, if necessary, to obtain a product.

According to the invention, each of Co, Ni, Ag, Cu, Hg and Au was uniformly adhered to both surfaces of th decarburization and primary recrystallization annealed sheet in an amount of 20 mg/m$^2$ or 500 mg/m$^2$ by a displacement plating method and the slurry of the annealing separator consisting mainly of MgO was applied thereto, which was then subjected to a final finish annealing for secondary recrystallization and purification annealing at 1200° C. for 10 hours.

The magnetic properties and bending properties of the thus obtained steel sheets were measured to obtain results as shown in Table 1. Moreover, the bending properties were evaluated by a repetitive bending test according to JIS C2550.

TABLE 1

| Plating element | Co | | Ni | | Ag | | Cu | | Hg | | Au | |
|---|---|---|---|---|---|---|---|---|---|---|---|---|
| Amount adhered to one-side surface (mg/m$^2$) | 20 | 500 | 20 | 500 | 20 | 500 | 20 | 500 | 20 | 500 | 20 | 500 |
| $B_8$ (T) | 1.89 | 1.88 | 1.88 | 1.80 | 1.88 | 1.79 | 1.89 | 1.83 | 1.88 | 1.74 | 1.89 | 1.78 |
| Bending number | 2 | 4 | 2 | 5 | 2 | 2 | 2 | 15 | 2 | 3 | 2 | 2 |

As seen from Table 1, when the lated amount is 500 mg/m$^2$, the magnetic properties ($B_8$) are degraded, but the bending number increases. Particularly, the effect is large in case of Cu plating.

Thus, in case of cu plating, the bending properties are improved, but the magnetic properties are reversely degraded. However, this can advantageously be compensated as seen from results of the following experiment.

The steel sheet after the final cold rolling was subjected to each of the following degreasing treatments:

A: usual degreasing in a solution of sodium orthosilicate;

B: degreasing with trichloroethane; and

C: electrolytic degreasing in a solution of sodium orthosilicate.

Thereafter, the degreased steel sheet was subjected to decarburization and primary recrystallization annealing in an atmosphere consisting of 50% $H_2$ and 50% $N_2$ and having a dew point of 60° C. at 840° C. for 5 minutes, and then Cu was uniformly adhered to both surfaces of the sheet in an amount of 1200 mg/m$^2$ per one-side surface by the displacement plating method. After the slurry of the annealing separator consisting mainly of MgO was applied, the sheet was subjected to the final finish annealing at 1200° C. for 10 hours. The magnetic properties and bending properties of the thus obtained steel sheets were measured to obtain results as shown in Table 2.

TABLE 2

| Degreasing method | A: degreasing with sodium orthosilicate | B: degreasing with tri-chloroethane | C: electrolytic degreasing with sodium orthosilicate |
|---|---|---|---|
| $B_8$ (T) | 1.83 | 1.82 | 1.88 |
| Bending number | 20 | 16 | 25 |

As seen from Table 2, when the sample sheet is subjected to the electrolytic degreasing with the solution of sodium orthosilicate after the final cold rolling, even if a great amount of Cu is adhered to the surface of the sheet after the decarburization and primary recrystallization annealing, the magnetic properties represented by $B_8$ are not degraded and also the bending properties are very excellent.

When the surfaces of the sheets after the degreasing treatments A, B and C were observed in order to elucidate the above phenomenon, it was confirmed that oxides and hydroxides of Si and Fe are existent at a mixed state only in the sample sheet electrolytic degreased with the solution of sodium orthosilicate.

The oxide and hydroxide of Si were derived from sodium silicate in the electrolytic degreasing bath. On the other hand, it was confirmed that the oxide and hydroxide of Fe were derived by electrodeposition of iron included in the bath. Furthermore, when examining the steel sheets after the decarburization and primary recrystallization annealing followed by the degreasing treatments A, B and C, it was confirmed that the subscale on the surface of the annealed sheet after the electrolytic degreasing treatment C was thick in the coating thickness and also silica was uniformly and finely dispersed in the subscale.

Figure 1B:
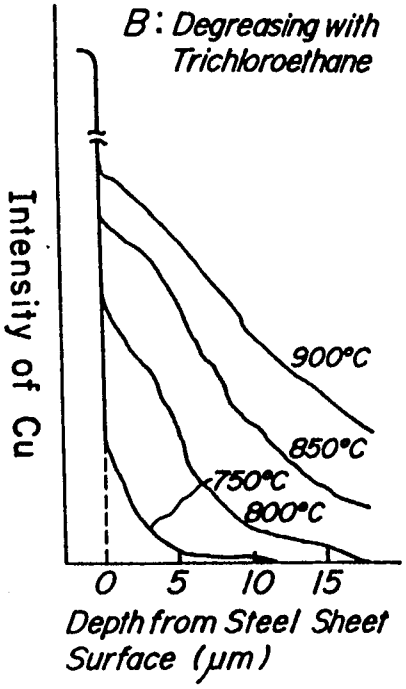
Figure 1A:
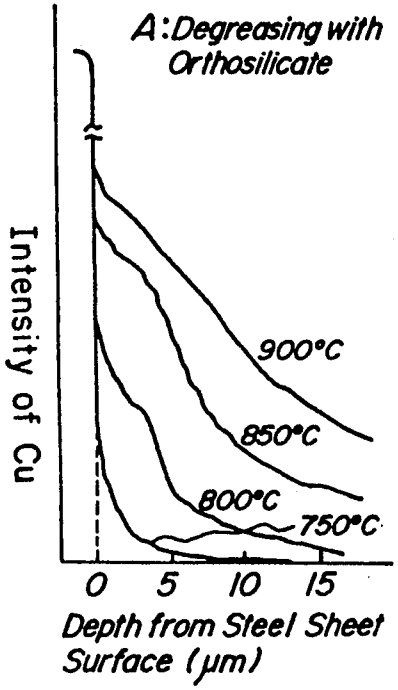

Then, Cu was uniformly adhered to the surface of such an annealed sheet in an amount of 800 mg/m$^2$ per one-side surface and held at various temperatures, during which the behavior of penetrating Cu from the surface into the inside of the sheet was examined by an EPMA line analysis to obtain results as shown in FIGS. 1*a* to 1*c*.

As shown in FIG. 1*c*, the penetration of Cu into steel is considerably suppressed at a temperature region of not higher than 850° C. in the sample sheet subjected to the electrolytic degreasing.

In general, it is said that the secondary recrystallization occurs at a temperature region of 800°-1000° C. and forsterite coating is formed by the reaction between the subscale and the annealing separator above 1050° C. Therefore as the temperature becomes considerably higher, the above subscale changes and hence there may be caused a phenomenon of disappearing the effect of suppressing the penetration of Cu into steel.

As mentioned above, the mechanism of improving the magnetic properties and bending properties by subjecting to the electrolytic degreasing in the solution of sodium orthosilicate lies in a point that the oxides and hydroxides of Si and Fe electrodeposited on the surface layer of the steel sheet by the electrolytic degreasing modify the subscale in the surface layer after the decarburization and primary recrystallization annealing to thereby control the amount of Cu penetrated into steel at the final annealing step. In other words, the concentration of Cu is controlled at a low level in the secondary recrystallization annealing step to produce good secondary recrystallized grains and a great amount of Cu is penetrated into steel at a higher temperature to improve the bending properties.

Such an effect by the electrolytic degreasing is first discovered by the inventors, which is dependent upon the concentration of iron existent in the electrolytic degreasing bath. Iron included in the bath is existent in form of iron compound as well as iron ions such as $Fe^{2+}$, $Fe^{3+}$, but it has been found that iron dispersed in the bath always develops the above effect irrespective of the existing form.

It has hitherto been known that the oxides and hydroxides of Si and Fe are electrodeposited on the surface of the silicon steel sheet after the electrolytic degreasing in the silicate bath. Among them, it is considered that the electrodeposited Si compound is useful and only the control of the electrodeposition amount is required. Therefore, the Fe series electrodeposited compounds has not been particularly noticed as a useless substance.

According to the invention, the quantitative evaluation of Fe series compound electrodeposited on the steel sheet surface is very difficult because the distinction from the steel sheet itself is difficult, so that the iron concentration in the bath is noted and controlled to provide the desired effect.

The preferable concentration range of iron in the bath and the timing of Cu adhering treatment will be described with reference to the following experiment.

The electrolytic degreasing was carried out by using electrolytic degreasing solutions having iron concentrations of 20, 32, 50, 120, 530, 1150, 3700, 5000, 7500 and 9800 mg/l while supplementing iron ion to a bath of an orthosilicate solution containing an iron concentration of 20 mg/l (the iron concentration in such a bath is usually 15-30 mg/l). The final cold rolled sheet was the same as used in the aforementioned experiment.

Thereafter, the cold rolled sheet was divided into two portions, one of which portions was uniformly plated at both surfaces with Cu in an amount of 800 mg/m$^2$ per one-side surface and the other portion was not plated with Cu. These portions were then subjected to decarburization and primary recrystallization annealing in 50% $H_2$-$N_2$ atmosphere having a dew point of 65° C. at 830° C. for 5 minutes. Thereafter, the portion not plated with Cu was uniformly plated at both surfaces with Cu in an amount of 850 mg/m$^2$ (per one-side surface). Then, these portions were coated with a slurry of an annealing separator consisting mainly of MgO and subjected to a final finish annealing at 1200° C. for 10 hours.

Figure 2:
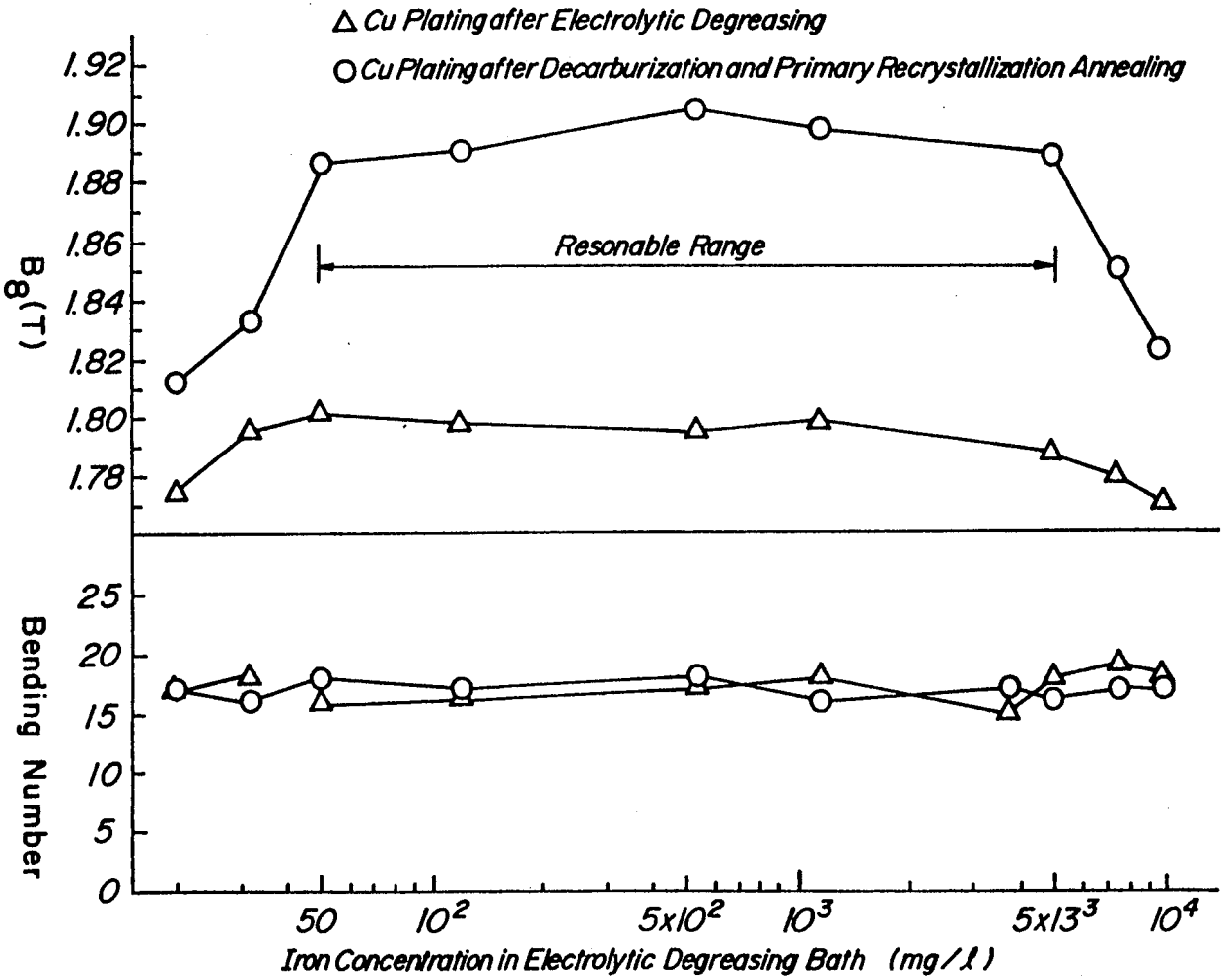
FIG. 2 is a graph showing a relation among iron concentration in the electrolytic degreasing bath, $B_8$ and bending properties.

The magnetic flux density and bending number of the thus obtained steel sheets were measured to obtain results as shown in FIG. 2.

As seen from FIG. 2, when the iron concentration in the bath is within a range of 50-5000 mg/l, the magnetic flux density is considerably improved.

Furthermore, it is understood that the timing of the Cu plating is suitable after the decarburization and primary recrystallization annealing. This is considered due to the fact that when the Cu plating is carried out before the decarburization and primary recrystallization annealing, the formation of subscale in the surface layer of the steel sheet at the decarburization and primary recrystallization annealing is suppressed by Cu existent on the surface, and consequently the proceeding of good secondary recrystallization is obstructed to degrade the magnetic properties.

Then, the experiment examining the adequate amount of Cu adhered to the steel sheet surface will be described.

The final cold rolled sheet was the same as used in the aforementioned experiment, and a solution of sodium orthosilicate containing an iron concentration of 1600 mg/l was used an an electrolytic degreasing bath. After the sheet was subjected to the electrolytic degreasing under usual treating conditions, it was subjected to decarburization and primary recrystallization annealing at 820° C. in an atmosphere of 40% $H_2$–$N_2$ having a dew point of 55° C. for 5 minutes and then Cu was plated onto one surface or both surfaces in an amount of 30, 63, 230, 400, 800, 1600, 2000, 3000 or 5000 mg/m$^2$ through an electric plating. Thereafter the sheet was coated with a slurry of an annealing separator consisting mainly of MgO and subjected to final finish annealing at 1200° C. for 10 hours.

Figure 3:
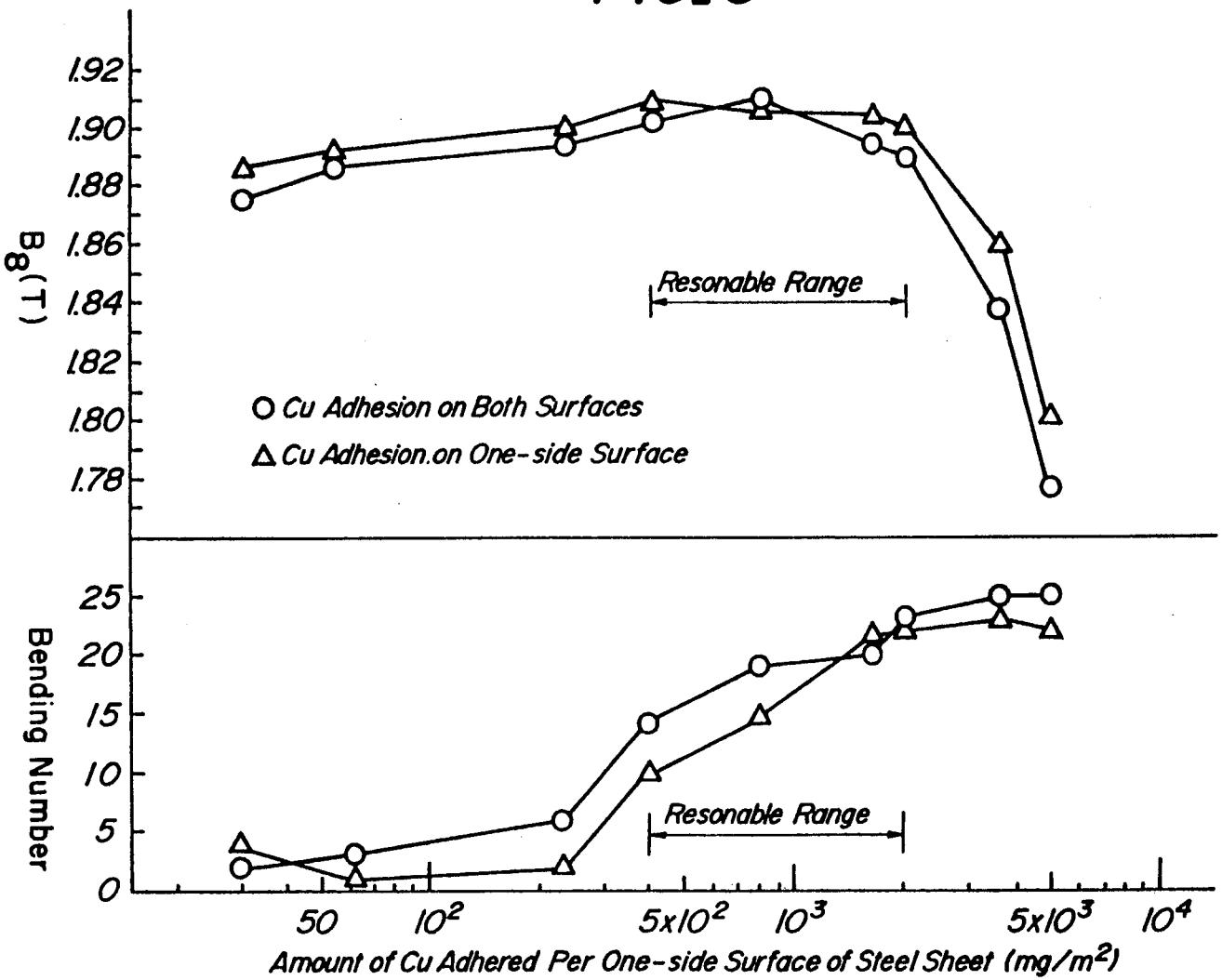
FIG. 3 is a graph showing a relation among Cu adhered amount to one-side surface of the steel sheet, $B_8$ and bending properties.

The magnetic properties and bending properties of the thus obtained steel sheets were measured to obtain results as shown in FIG. 3.

As seen from FIG. 3, the adequate amount of Cu adhered to the steel sheet surface is 400–2000 mg/m$^2$, preferably 600–1800 mg/m$^2$. When the amount of Cu adhered is less than 400 mg/m$^2$, the bending properties are poor, while when it exceeds 2000 mg/m$^2$, the magnetic flux density $B_8$ is poor.

There is no great difference in the effect of Cu adhesion between one surface and both surfaces of the sheet, but the effect is slightly excellent in the adhesion to both surfaces.

According to the invention, hot rolled coils obtained by well-known production methods, for example, hot rolled coils obtained by steel-making in a convertor, an electric furnace or the like, shaping into a slab through ingot blooming process or continuous casting process and subjecting to hot rolling are used as a starting material.

This hot rolled sheet is required to have a composition containing 2.0–4.0 wt% (hereinafter shown by simply) of Si. Because, when Si is less than 2.0%, the degradation of iron loss value is large, while when it exceeds 4.0%, the cold workability is degraded.

As the other ingredients, use may be made of any ingredients usually used in the grain oriented silicon steel sheet. However, at least one of S, Se and Al is necessary to be included as an inhibitor ingredient. In this case, the adequate amount of S is 0.015–0.025%, and the adequate amount of Se is 0.010–0.025%, and the adequate amount of Al is 0.010–0.035%. When the amount of each of these elements is outside the above range, it is difficult to uniformly and finely disperse the inhibitor into steel.

After the removal of scale, the hot rolled sheet is subjected to a heavy cold rolling or two-times cold rolling through an intermediate annealing up to a final target thickness. If necessary, normalized annealing of the hot rolled sheet or warm rolling instead of the cold rolling may be carried out.

The cold rolled sheet having a final thickness is degreased at its surface by electrolytic degreasing. The electrolytic degreasing conditions may be the same as in the usual used conditions, but it is important to use a solution containing silicate as an electrolytic degreasing bath. That is, sodium orthosilicate ($Na_4SiO_4$), sodium metasilicate ($Na_2SiO_3$), so-called water-glass being liquid mixture of various sodium silicates or the like is suitable as the electrolytic degreasing bath. Furthermore, potassium, lithium or the like may be used instead of sodium as a silicate. In any case, a mol ratio of metallic ion to Si is irrespective of. As the composition of the electrolytic degreasing bath, the concentration of the silicate is usually about 0.1–10% for satisfying both the degreasing and the Si adhesion, and the presence of the other ingredients is irrespective except that according to the invention, it is essential to severely control the iron concentration in the bath to a range of 50–5000 mg/l.

After the electrolytic degreasing, the steel sheet is subjected to an annealing in a wet hydrogen atmosphere for decarburization and primary recrystallization annealing. Then, Cu is adhered to the surface(s) of the steel sheet. In this case, the amount of Cu adhered is required to be 400–2000 mg/m$^2$ per one-side surface as previously mentioned. Although the Cu adhered surface is one-side surface or both surfaces of the sheet, it is important to uniformly adhere Cu to the surface(s) of the sheet. Moreover, if a portion having a Cu adhered amount outside the above range is locally produced on the steel sheet surface, the object of the invention for improving not only the magnetic properties but also the bending properties is not achieved in this portion.

As a method of adhering Cu, there may be used anyone of conventionally well-known methods such as so-called displacement plating of immersing into an aqueous solution of copper sulfate, method of electrodeposition onto the steel sheet surface through electrical plating and the like.

Thereafter, the sheet is coated with a slurry of an annealing separator consisting mainly of MgO and subjected to a final finish annealing. As a means for applying the annealing separator to the sheet surface, there may be adopted the conventionally well-known methods such as application with roll or brush, spraying, electrostatic coating and the like.

After the final finish annealing, the unreacted annealing separator is removed and then the sheet is subjected to an insulative topcoating or a flattening annealing, if necessary to obtain a product. Moreover, a tension-applying type coating is preferable as the insulative topcoating from a viewpoint of the magnetic properties.

Grain oriented silicon steel sheets having improved magnetic properties and bending properties can stably be obtained by the above method.

The following examples are given in illustration of the invention and are not intended as limitations thereof.

EXAMPLE 1

Each of slabs A, B, C, D and E having a chemical composition as shown in Table 3 was heated and hot rolled in the usual manner to obtain hot rolled sheets having thicknesses of 1.6 mm, 2.0 mm and 2.4 mm. These hot rolled sheets were annealed at 1000° C. for 1 minute, pickled and cold rolled to an intermediate thickness of 0.40 mm, 0.65 mm or 0.80 mm. Then, the cold rolled sheet was subjected to an intermediate annealing at 950° C. for 1 minute and finally cold rolled to a final thickness of 0.15 mm, 0.23 mm or 0.30 mm.

Thereafter, a half of the resulting cold rolled sheets was subjected to an electroless degreasing and the remaining half was subjected to an electrolytic degreasing in a bath of sodium orthosilicate containing an iron concentration of 1200 mg/l. Then, the sheet was subjected to decarburization and primary recrystallization annealing, uniformly coated at both surfaces with Cu in an amount of 800 mg/m$^2$ per one-side surface through displacement plating, further coated with a slurry of an annealing separator consisting mainly of MgO, and then subjected to final finish annealing consisting secondary recrystallization annealing at 850° C. for 80 hours and purification annealing at 1200° C. for 5 hours.

The magnetic properties and bending properties of the thus obtained sheet products are shown in Table 4.

annealing at 950° C. for 1 minute and finally cold rolled to a final thickness of 0.30 mm. Thereafter, the cold rolled sheet was divided into three portions, which were subjected to an electrolytic degreasing in a bath of potassium orthosilicate containing iron concentrations of 22 mg/l, 240 mg/l and 8400 mg/l, respectively.

Then, these sheets were subjected to decarburization and primary recrystallization annealing, uniformly coated at both surfaces with Cu in an amount of 1600

TABLE 3

| | Chemical composition (%) | | | | | | | | | | | | | | |
|---|---|---|---|---|---|---|---|---|---|---|---|---|---|---|---|
| Slab | C | Si | Mn | P | Al | S | Se | Mo | Cu | Sb | Ge | Cr | Sn | Bi | N (ppm) |
| A | 0.042 | 3.35 | 0.068 | 0.003 | 0.001 | 0.003 | 0.017 | tr | 0.02 | 0.025 | tr | 0.01 | 0.01 | tr | 40 |
| B | 0.039 | 3.28 | 0.072 | 0.003 | 0.001 | 0.002 | 0.018 | 0.010 | 0.02 | 0.023 | tr | 0.01 | 0.01 | tr | 35 |
| C | 0.042 | 3.30 | 0.073 | 0.004 | 0.001 | 0.004 | 0.020 | 0.010 | 0.02 | 0.020 | 0.015 | 0.02 | 0.02 | tr | 32 |
| D | 0.040 | 3.36 | 0.069 | 0.003 | 0.002 | 0.003 | 0.022 | tr | 0.01 | 0.022 | tr | 0.01 | 0.01 | 0.005 | 34 |
| E | 0.035 | 3.29 | 0.070 | 0.003 | 0.001 | 0.002 | 0.021 | 0.015 | 0.02 | 0.025 | tr | 0.01 | 0.08 | tr | 38 |
| F | 0.036 | 3.08 | 0.068 | 0.004 | 0.002 | 0.018 | tr | tr | 0.02 | tr | tr | 0.02 | 0.02 | tr | 32 |
| G | 0.037 | 3.12 | 0.070 | 0.006 | 0.001 | 0.016 | tr | tr | 0.01 | tr | tr | 0.01 | 0.09 | tr | 30 |
| H | 0.040 | 3.17 | 0.071 | 0.005 | 0.002 | 0.019 | tr | tr | 0.02 | 0.020 | tr | 0.02 | 0.02 | tr | 34 |
| I | 0.070 | 3.35 | 0.073 | 0.003 | 0.020 | 0.018 | tr | tr | 0.02 | tr | tr | 0.02 | 0.10 | tr | 75 |
| J | 0.065 | 3.28 | 0.078 | 0.004 | 0.018 | 0.017 | tr | tr | 0.02 | tr | tr | 0.01 | 0.02 | tr | 83 |
| K | 0.073 | 3.32 | 0.075 | 0.004 | 0.025 | 0.020 | tr | tr | 0.01 | 0.023 | tr | 0.01 | 0.02 | tr | 78 |
| L | 0.072 | 3.34 | 0.082 | 0.012 | 0.022 | 0.004 | tr | tr | 0.02 | tr | tr | 0.01 | 0.02 | tr | 85 |
| M | 0.075 | 3.28 | 0.080 | 0.005 | 0.024 | 0.004 | tr | tr | 0.01 | tr | tr | 0.07 | 0.02 | tr | 80 |
| N | 0.073 | 3.29 | 0.075 | 0.007 | 0.023 | 0.004 | tr | tr | 0.01 | 0.025 | tr | 0.02 | 0.01 | tr | 83 |
| O | 0.069 | 3.35 | 0.068 | 0.004 | 0.027 | 0.003 | 0.021 | tr | 0.02 | 0.020 | tr | 0.01 | 0.02 | tr | 88 |
| P | 0.072 | 3.28 | 0.073 | 0.004 | 0.025 | 0.002 | 0.020 | 0.012 | 0.01 | 0.025 | tr | 0.01 | 0.02 | tr | 86 |
| Q | 0.070 | 3.33 | 0.070 | 0.003 | 0.026 | 0.002 | 0.020 | tr | 0.02 | 0.020 | 0.013 | 0.02 | 0.02 | tr | 85 |
| R | 0.068 | 3.35 | 0.068 | 0.004 | 0.028 | 0.003 | 0.018 | tr | 0.02 | 0.024 | tr | 0.02 | 0.01 | 0.008 | 84 |
| S | 0.073 | 3.32 | 0.073 | 0.003 | 0.024 | 0.003 | 0.017 | tr | 0.01 | tr | tr | 0.01 | 0.01 | tr | 89 |

TABLE 4

| Slab | Final thickness (mm) | Presence or absence of electrolytic degreasing | $B_8$ (T) | $W_{17/50}$ (W/kg) | Bending number | Remarks |
|---|---|---|---|---|---|---|
| A | 0.15 | presence | 1.884 | 0.78 | 18 | acceptable example |
| | | absence | 1.746 | 1.06 | 22 | comparative example |
| | 0.23 | presence | 1.922 | 0.80 | 19 | acceptable example |
| | | absence | 1.838 | 1.05 | 20 | comparative example |
| | 0.30 | presence | 1.923 | 0.96 | 18 | acceptable example |
| | | absence | 1.882 | 1.09 | 19 | comparative example |
| B | 0.15 | presence | 1.882 | 0.77 | 23 | acceptable example |
| | | absence | 1.734 | 1.05 | 19 | comparative example |
| | 0.23 | presence | 1.924 | 0.81 | 18 | acceptable example |
| | | absence | 1.806 | 1.13 | 18 | comparative example |
| | 0.30 | presence | 1.925 | 0.96 | 19 | acceptable example |
| | | absence | 1.865 | 1.12 | 17 | comparative example |
| C | 0.15 | presence | 1.880 | 0.75 | 23 | acceptable example |
| | | absence | 1.707 | 1.09 | 20 | comparative example |
| | 0.23 | presence | 1.920 | 0.79 | 19 | acceptable example |
| | | absence | 1.846 | 1.03 | 22 | comparative example |
| | 0.30 | presence | 1.925 | 0.95 | 18 | acceptable example |
| | | absence | 1.868 | 1.16 | 15 | comparative example |
| D | 0.15 | presence | 1.892 | 0.73 | 24 | acceptable example |
| | | absence | 1.763 | 1.08 | 26 | comparative example |
| | 0.23 | presence | 1.913 | 0.85 | 23 | acceptable example |
| | | absence | 1.817 | 1.01 | 18 | comparative example |
| | 0.30 | presence | 1.920 | 0.99 | 16 | acceptable example |
| | | absence | 1.836 | 1.23 | 15 | comparative example |
| E | 0.15 | presence | 1.879 | 0.79 | 24 | acceptable example |
| | | absence | 1.773 | 1.05 | 26 | comparative example |
| | 0.23 | presence | 1.922 | 0.80 | 21 | acceptable example |
| | | absence | 1.803 | 1.13 | 17 | comparative example |
| | 0.30 | presence | 1.920 | 0.96 | 18 | acceptable example |
| | | absence | 1.818 | 1.16 | 16 | comparative example |

EXAMPLE 2

Each of slabs F, G and H having a chemical composition as shown in Table 3 was heated and hot rolled in the usual manner to obtain hot rolled sheets having a thickness of 2.3 mm, which were pickled and cold rolled to an intermediate thickness of 0.75 mm. Then, the cold rolled sheet was subjected to an intermediate mg/m$^2$ through an electrical plating, further coated with a slurry of an annealing separator consisting mainly of MgO, and then subjected to final finish annealing at 1200° C. for 10 hours after the temperature was raised to conduct secondary recrystallization.

The magnetic properties and bending properties of the thus obtained sheet products are shown in Table 5.

TABLE 5

| Slab | Fe concentration in electrolytic degreasing bath (mg/l) | $B_8$ (T) | $W_{17/50}$ (W/kg) | Bending number | Remarks |
|---|---|---|---|---|---|
| F | 22 | 1.736 | 1.293 | 22 | comparative example |
| | 240 | 1.874 | 1.085 | 18 | acceptable example |
| | 8400 | 1.778 | 1.206 | 19 | comparative example |
| G | 22 | 1.708 | 1.349 | 21 | comparative example |
| | 240 | 1.855 | 1.067 | 23 | acceptable example |
| | 8400 | 1.763 | 1.157 | 19 | comparative example |
| H | 22 | 1.774 | 1.313 | 18 | comparative example |
| | 240 | 1.893 | 1.064 | 22 | acceptable example |
| | 8400 | 1.785 | 1.163 | 20 | comparative example |

EXAMPLE 3

Each of slabs I, J, K, L, M, N, 0, P, Q, R and S having a chemical composition as shown in Table 3 was heated and hot rolled in the usual manner to obtain hot rolled sheets having a thickness of 2.0 mm. Then, the sheet was annealed at 1000° C. for 1 minute, pickled, cold rolled to an intermediate thickness of 1.50 mm, and then cold rolled to a thickness of 0.75 mm through an intermediate annealing including a quenching at 1100° C. for 1 minute. Thereafter, the cold rolled sheet was subjected to an aging treatment in a continuous tension furnace at 350° C. for 1 minute, again cooled to room temperature and then cold rolled to a final thickness of 0.23 mm.

Then, the cold rolled sheet was subjected to an electrolytic degreasing in a bath of sodium orthosilicate containing an iron concentration of 800 mg/l and further to decarburization and primary recrystallization annealing. Thereafter, the sheet was divided into three portions, which were uniformly coated at both surfaces with Cu in amounts of 150 mg/m$^2$, 1200 mg/m$^2$ and 3500 mg/m$^2$ per one-side surface through displacement plating, respectively. This sheet was coated with a slurry of an annealing separator consisting mainly of MgO and subjected to final finish annealing at 1200° C. for 10 hours after the temperature was raised to conduct secondary recrystallization.

The magnetic properties and bending properties of the thus obtained sheet products are shown in Table 6.

TABLE 6

| Slab | Cu adhered amount (per one-side surface) (mg/m$^2$) | $B_8$ (T) | $W_{17/50}$ (W/kg) | Bending number | Remarks |
|---|---|---|---|---|---|
| I | 150 | 1.913 | 0.95 | 4 | comparative example |
| | 1200 | 1.926 | 0.90 | 21 | acceptable example |
| | 3500 | 1.873 | 1.12 | 23 | comparative example |
| J | 150 | 1.895 | 1.03 | 4 | comparative example |
| | 1200 | 1.918 | 0.95 | 25 | acceptable example |
| | 3500 | 1.864 | 1.08 | 32 | comparative example |
| K | 150 | 1.916 | 0.98 | 3 | comparative example |
| | 1200 | 1.924 | 0.92 | 20 | acceptable example |
| | 3500 | 1.883 | 1.05 | 21 | comparative example |
| L | 150 | 1.898 | 1.06 | 2 | comparative example |
| | 1200 | 1.913 | 0.96 | 23 | acceptable example |
| | 3500 | 1.866 | 1.10 | 26 | comparative example |
| M | 150 | 1.910 | 1.03 | 3 | comparative example |
| | 1200 | 1.915 | 0.97 | 24 | acceptable example |
| | 3500 | 1.857 | 1.15 | 26 | comparative example |
| N | 150 | 1.920 | 0.99 | 4 | comparative example |
| | 1200 | 1.925 | 0.97 | 19 | acceptable example |
| | 3500 | 1.878 | 1.09 | 22 | comparative example |
| O | 150 | 1.925 | 0.95 | 3 | comparative example |
| | 1200 | 1.933 | 0.87 | 23 | acceptable example |
| | 3500 | 1.905 | 1.02 | 22 | comparative example |
| P | 150 | 1.930 | 0.90 | 3 | comparative example |
| | 1200 | 1.935 | 0.86 | 20 | acceptable example |
| | 3500 | 1.903 | 1.05 | 25 | comparative example |
| Q | 150 | 1.932 | 0.85 | 4 | comparative example |
| | 1200 | 1.936 | 0.82 | 23 | acceptable example |
| | 3500 | 1.907 | 1.03 | 29 | comparative example |
| R | 150 | 1.935 | 0.87 | 4 | comparative example |
| | 1200 | 1.940 | 0.85 | 19 | acceptable example |
| | 3500 | 1.921 | 1.04 | 24 | comparative example |
| S | 150 | 1.932 | 0.93 | 3 | unacceptable example |
| | 1200 | 1.938 | 0.88 | 23 | acceptable example |
| | 3500 | 1.915 | 1.08 | 27 | unacceptable example |

As mentioned above, according to the invention, grain oriented silicon steel sheets having improved magnetic properties and bending properties can advantageously be obtained.

What is claimed is:

1. In a method of producing grain oriented silicon steel sheets having improved magnetic properties and bending properties wherein a series of steps is performed including hot rolling a slab of silicon steel containing at least one of S, Se, and Al as an inhibitor, subjecting the resulting hot rolled sheet to a heavy cold rolling or two cold rolling steps through intermediate annealing to provide a cold rolled sheet of a final thickness, subjecting the resulting cold rolled sheet to decarburization and primary recrystallization annealing, applying a slurry of an annealing separator consisting mainly of MgO to the surface of the steel sheet and then subjecting it to secondary recrystallization annealing and purification annealing, the steps which comprises subjecting the steel sheet after final cold rolling to electrolytic degreasing in an electrolytic degreasing bath of a silicate solution containing 50–5000 mg/l of iron therein, and coating one or both surfaces of the steel sheet after decarburization and primary recrystallization annealing uniformly with Cu in an amount of 400–2000 mg/m$^2$ per sheet surface.

2. The method according to claim 1, wherein the amounts of S, Se and Al as an inhibitor are 0.015–0.025 wt%, 0.010–0.025 wt% and 0.010–0.035 wt%, respectively.

3. The method according to claim 1, wherein said electrolytic degreasing bath contains 0.1–10 wt% of silicate.

4. The method according to claim 1, wherein the amount of Cu adhered per surface of said sheet is 600–1800 mg/m$^2$.

* * * * *